US009233695B2

(12) United States Patent
Ogawa et al.

(10) Patent No.: US 9,233,695 B2
(45) Date of Patent: Jan. 12, 2016

(54) RAILCAR DAMPING DEVICE

(75) Inventors: Takayuki Ogawa, Sagamihara (JP); Jun Aoki, Sagamihara (JP); Masaru Uchida, Sagamihara (JP); Chie Yabuki, Sagamihara (JP)

(73) Assignee: KAYABA INDUSTRY CO., LTD., Tokyo (JP)

( * ) Notice: Subject to any disclaimer, the term of this patent is extended or adjusted under 35 U.S.C. 154(b) by 61 days.

(21) Appl. No.: 14/127,916

(22) PCT Filed: Jun. 19, 2012

(86) PCT No.: PCT/JP2012/065607

§ 371 (c)(1),
(2), (4) Date: Dec. 19, 2013

(87) PCT Pub. No.: WO2012/176762

PCT Pub. Date: Dec. 27, 2012

(65) Prior Publication Data

US 2014/0196628 A1 Jul. 17, 2014

(30) Foreign Application Priority Data

Jun. 20, 2011 (JP) ..... 2011-136162

(51) Int. Cl.
*B61F 5/24* (2006.01)
*F15B 7/00* (2006.01)

(52) U.S. Cl.
CPC . *B61F 5/24* (2013.01); *B61F 5/245* (2013.01); *F15B 7/006* (2013.01); *F15B 2211/7053* (2013.01); *F15B 2211/785* (2013.01)

(58) Field of Classification Search
CPC ..... B61F 5/00; B61F 5/02; B61F 5/04; B61F 5/10; B61F 5/12; B61F 5/127; B61F 5/38; B61F 5/386
USPC ..... 105/157.1, 164, 171, 176, 194, 105/198.1–198.3, 209, 453
See application file for complete search history.

(56) References Cited

U.S. PATENT DOCUMENTS 3,854,420 A * 12/1974 Hinnen et al. ..... 105/176
2002/0184881 A1 12/2002 Oka
2011/0192157 A1 8/2011 Ogawa

FOREIGN PATENT DOCUMENTS

EP 2216228 A1 8/2010
JP S55-135210 A 10/1980

(Continued)

OTHER PUBLICATIONS

Extended European Search Report dated Feb. 26, 2015.

*Primary Examiner* — R. J. McCarry, Jr.
(74) *Attorney, Agent, or Firm* — Rabin & Berdo, P.C.

(57) ABSTRACT

A railcar damping device includes: a tank storing a liquid; a first opening/closing valve provided in a first passage connecting a rod side chamber and a piston side chamber, which are defined by a piston, to be capable of opening and closing the first passage; a second opening/closing valve provided in a second passage connecting the piston side chamber and the tank to be capable of opening and closing the second passage; a pump that is driven to rotate at a predetermined normal rotation speed in order to supply the liquid from the tank to the rod side chamber; and a temperature determination unit that determines a temperature of the liquid supplied to the actuator, wherein a rotation speed of the pump is reduced below a normal rotation speed when the temperature determination unit determines that the temperature of the liquid is lower than a predetermined temperature.

11 Claims, 4 Drawing Sheets

(56) References Cited

FOREIGN PATENT DOCUMENTS

| | | | |
|---|---|---|---|
| JP | S63-101504 | A | 5/1988 |
| JP | 2000-177586 | A | 6/2000 |
| JP | 2000-289977 | A | 10/2000 |
| JP | 2002-364603 | A | 12/2002 |
| JP | 2003118571 | A | 4/2003 |
| JP | 2003-285637 | A | 10/2003 |
| JP | 2005-299450 | A | 10/2005 |
| JP | 2010-065797 | A | 3/2010 |
| JP | 2011-88623 | | 5/2011 |
| WO | WO-2010030025 | A1 | 3/2010 |

* cited by examiner

RAILCAR DAMPING DEVICE

TECHNICAL FIELD

This invention relates to an improvement in a railcar damping device.

BACKGROUND ART

A known example of a conventional railcar damping device is interposed between a vehicle body and a truck of a railcar and used to suppress left-right direction vibration relative to an advancement direction.

JP2010-65797A discloses a railcar damping device including: a cylinder coupled to either a truck or a vehicle body of a railcar; a piston inserted into the cylinder to be free to slide; a rod inserted into the cylinder and coupled to the other of the truck and the vehicle body and to the piston; a rod side chamber and a piston side chamber defined within the cylinder by the piston; a tank storing a liquid that is supplied to the cylinder; a first opening/closing valve provided midway in a first passage that connects the rod side chamber to the piston side chamber; a second opening/closing valve provided midway in a second passage that connects the piston side chamber to the tank; a pump that supplies working oil to the rod side chamber; an exhaust passage that connects the rod side chamber to the tank; and a variable relief valve that is provided midway in the exhaust passage and has a modifiable valve opening pressure. By driving the pump, the first opening/closing valve, the second opening/closing valve, and the variable relief valve, an actuator can generate thrust in both an expansion direction and a contraction direction, and vibration of the vehicle body is suppressed by this thrust.

SUMMARY OF INVENTION

Incidentally, in this railcar damping device, the pump is driven to rotate at a predetermined rotation speed (a rotation speed per unit time), while the first opening/closing valve, the second opening/closing valve, and the variable relief valve are driven appropriately in accordance with a vibration condition of the vehicle body. Thus, vibration of the railcar is suppressed by obtaining thrust for suppressing the vibration of the vehicle body using oil pressure.

When an oil temperature of the working oil in the actuator is low, however, a viscosity of the working oil increases. Therefore, particularly when the actuator is caused to generate comparatively small thrust, pressure loss in the variable relief valve, pressure loss due to pipe resistance, and so on increase. As a result, an internal pressure of the cylinder may become too high, leading to excessive thrust.

Further, if the thrust becomes excessive when attempting to perform feedback control by feeding back the thrust of the actuator, a deviation between a control command and an actual thrust increases, leading to hunting in which the thrust of the actuator becomes oscillatory. As a result, vibration in the vehicle body may worsen.

This invention has been designed in consideration of the problems described above, and an object thereof is to provide a railcar damping device that can suppress vehicle body vibration effectively by generating stable thrust even when an oil temperature of working oil is low.

According to one aspect of this invention, a railcar damping device that suppresses vibration of a vehicle body by controlling an actuator is provided. The actuator includes: a cylinder coupled to one of a truck and a vehicle body of a railcar; a piston inserted into the cylinder to be free to slide; a rod inserted into the cylinder and coupled to the piston and the other of the truck and the vehicle body; and a rod side chamber and a piston side chamber defined within the cylinder by the piston. The railcar damping device includes: a tank that is configured to store a liquid that is supplied to and discharged from the cylinder; a first opening/closing valve provided in a first passage connecting the rod side chamber to the piston side chamber to be capable of opening and closing the first passage; a second opening/closing valve provided in a second passage connecting the piston side chamber to the tank to be capable of opening and closing the second passage; a pump that is configured to be driven to rotate at a predetermined normal rotation speed in order to supply the liquid from the tank to the rod side chamber; and a temperature determination unit that is configured to determine a temperature of the liquid supplied to the actuator. A rotation speed of the pump is reduced below the normal rotation speed when the temperature determination unit determines that the temperature of the liquid is lower than a predetermined temperature.

The details as well as other features and advantages of this invention are set forth in the remainder of the specification and are shown in the accompanying drawings.

DESCRIPTION OF EMBODIMENTS

Referring to the figures, a railcar damping device 1 according to an embodiment of this invention will be described below.

Figure 1:
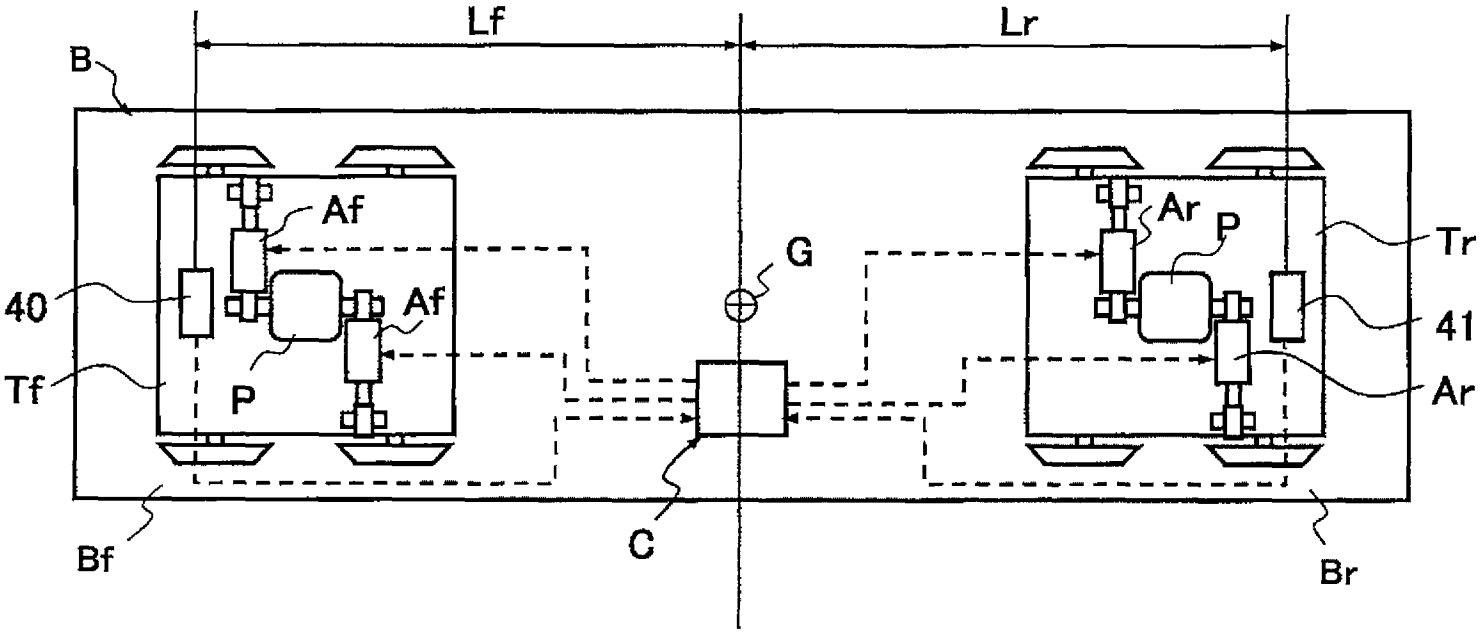
FIG. 1 is a plan view showing a configuration of a railcar installed with a railcar damping device according to an embodiment of this invention.

The railcar damping device 1 is used as a damping device for a vehicle body B of a railcar. As shown in FIG. 1, the railcar damping device 1 includes a front side actuator Af interposed between a front side truck Tf and the vehicle body B, a rear side actuator Ar interposed between a rear side truck Tr and the vehicle body B, and a controller C that actively controls the two actuators Af, Ar. The railcar damping device 1 determines a thrust to be output by the actuators Af, Ar as a thrust command value, and suppresses vibration of the vehicle body B by controlling the actuators Af, Ar.

The actuator Af and the actuator Ar are respectively provided in pairs. The front and rear actuators Af, Ar are coupled to pins P suspended downward from the vehicle body B of the railcar so as to be interposed in respective parallel pairs between the vehicle body B and the front and rear trucks Tf, Tr.

Basically, the front and rear actuators Af, Ar are actively controlled to suppress vibration of the vehicle body B in a horizontal lateral direction relative to a vehicle advancement direction. In this case, the controller C performs active control to control the front and rear actuators Af, Ar such that vibration of the vehicle body B in a lateral direction is suppressed.

More specifically, when performing control to suppress vibration of the vehicle body B, the controller C detects a lateral direction acceleration $\alpha f$ of a front portion Bf of the vehicle body B in a horizontal lateral direction relative to the vehicle advancement direction and a lateral direction acceleration $\alpha r$ of a rear portion Br of the vehicle body B in a horizontal lateral direction relative to the vehicle advancement direction. The controller C then calculates a yaw acceleration $\omega$, which is an angular acceleration about a vehicle body center G directly above the front and rear trucks Tf, Tf, on the basis of the detected lateral direction acceleration $\alpha f$ and lateral direction acceleration $\alpha r$. The controller C also calculates a sway acceleration $\beta$, which is an acceleration in a horizontal lateral direction of the vehicle body center G, on the basis of the detected lateral direction acceleration of and lateral direction acceleration $\alpha r$. The controller C then calculates thrust command values Ff, Fr, which are values of the thrust to be generated individually by the front and rear actuators Af, Ar, on the basis of the calculated yaw acceleration $\omega$ and sway acceleration $\beta$. The controller C then performs feedback control such that thrust corresponding to the thrust command values Ff, Fr is generated by the front and rear actuators Af, Ar, and in so doing suppresses vibration of the vehicle body B in the lateral direction.

In FIG. 1, two each of the actuator Af and the actuator Ar are provided, and the actuators Af, Ar are controlled by the single controller C. Instead, however, one controller C may be provided for each of the actuators Af, Ar.

Figure 2:
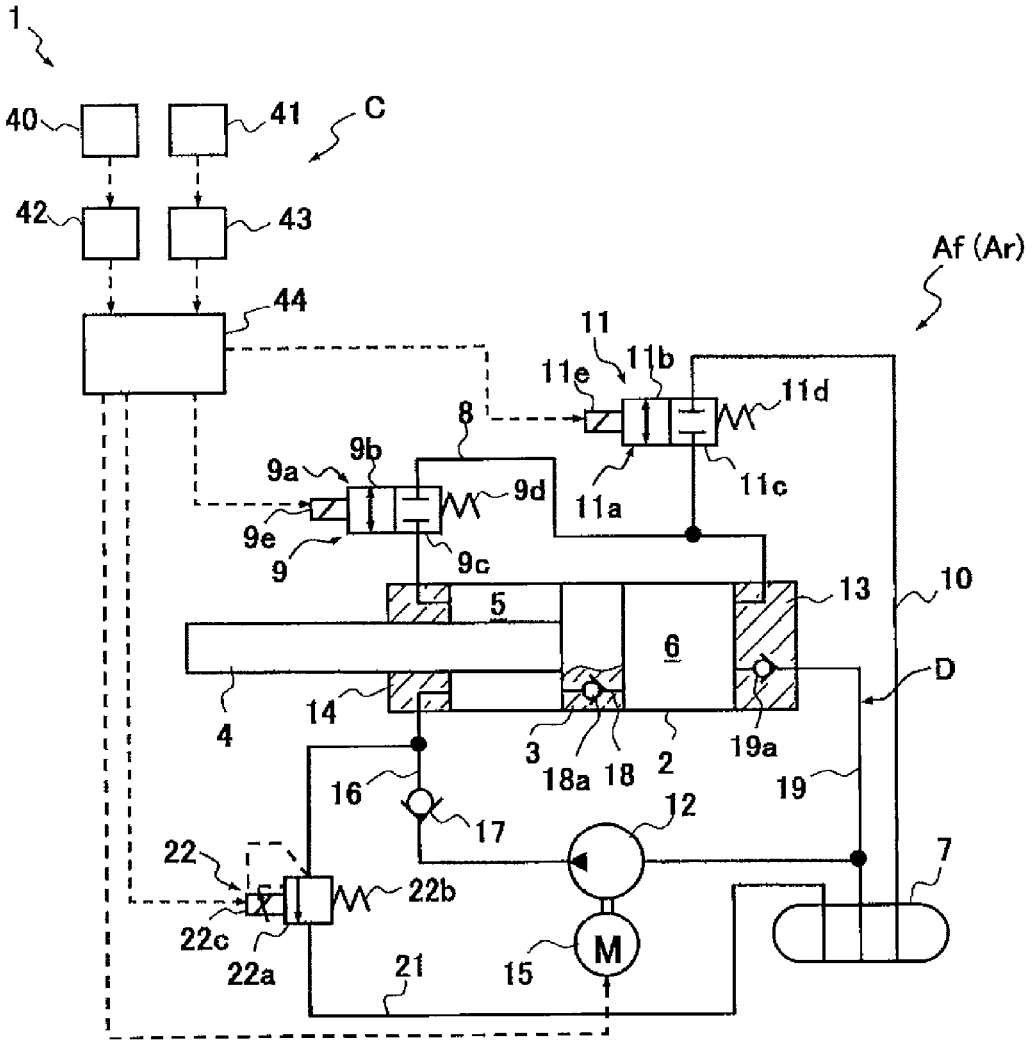
FIG. 2 is a detailed view of the railcar damping device according to this embodiment of this invention.

Next, referring to FIG. 2, a specific configuration of the railcar damping device 1 will be described.

Respective railcar damping devices 1 for expanding and contracting the front and rear actuators Af, Ar are configured similarly, and therefore, to avoid duplicate description, only the configuration of the railcar damping device 1 including the front side actuator Af will be described below, while specific description of the railcar damping device 1 including the rear side actuator Ar will be omitted.

The actuator Af includes a cylinder 2 coupled to one of the truck Tf and the vehicle body B of the railcar, a piston 3 inserted into the cylinder 2 to be free to slide, a rod 4 inserted into the cylinder 2 and coupled to the other of the truck Tf and the vehicle body B and to the piston 3, and a rod side chamber 5 and a piston side chamber 6 defined within the cylinder 2 by the piston 3. The actuator Af is constituted by a single rod type actuator. The railcar damping device 1 also includes a tank 7 storing working oil as a liquid that is supplied to and discharged from the cylinder 2, a first opening/closing valve 9 provided in a first passage 8 that connects the rod side chamber 5 to the piston side chamber 6 to be capable of opening and closing the first passage 8, a second opening/closing valve 11 provided in a second passage 10 that connects the piston side chamber 6 to the tank 7 to be capable of opening and closing the second passage 10, and a pump 12 that is driven to rotate at a predetermined normal rotation speed in order to supply the working oil to the rod side chamber 5 from the tank 7. The working oil is charged into rod side chamber 5 and the piston side chamber 6, and a gas is charged into the tank 7 in addition to the working oil. It should be noted that there is no particular need to set the tank 7 in a pressurized condition by compressing the gas charged therein.

The actuator Af performs an expansion operation by driving the pump 12 in a condition where the first passage 8 is set in a communicative condition by the first opening/closing valve 9 and the second opening/closing valve 11 is closed. Further, the actuator Af performs a contraction operation by driving the pump 12 in a condition where the second passage 10 is set in a communicative condition by the second opening/closing valve 11 and the first opening/closing valve 9 is closed.

The respective parts of the actuator Af will now be described in detail.

The cylinder 2 is formed in a tubular shape. One end (a right end in FIG. 2) of the cylinder 2 is closed by a lid 13, and an annular rod guide 14 is attached to another end (a left end in FIG. 2). The rod 4 inserted into the cylinder 2 to be free to move is inserted into the rod guide 14 to be free to slide. The rod 4 projects to the exterior of the cylinder 2 at one end, and another end is coupled to the piston 3 inserted into the cylinder 2 to be free to slide.

An outer periphery of the rod 4 is sealed from the rod guide 14 by a seal member, not shown in the figures. As a result, the interior of the cylinder 2 is maintained in an airtight condition. As described above, the working oil is charged into the rod side chamber 5 and the piston side chamber 6 defined within the cylinder 2 by the piston 3. Another liquid suitable for an actuator may be used as the liquid charged into the cylinder 2 instead of the working oil.

In the actuator Af, the rod 4 is formed such that a sectional area thereof is half a sectional area of the piston 3. In other words, a pressure receiving surface area of the piston 3 on the rod side chamber 5 side is half a pressure receiving surface area of the piston 3 on the piston side chamber 6 side. Hence, when a pressure in the rod side chamber 5 is set to be identical during the expansion operation and the contraction operation, an identical thrust is generated during both expansion and contraction. Further, an amount of working oil supplied to and discharged from the rod side chamber 5 relative to a displacement amount of the actuator Af is identical on both the expansion and the contraction sides.

More specifically, when the actuator Af is caused to perform the expansion operation, the rod side chamber 5 and the piston side chamber 6 communicate via the first passage 8 such that a working oil pressure in the rod side chamber 5 and a working oil pressure in the piston side chamber 6 are equal. As a result, a thrust obtained by multiplying the pressure of the working oil by a pressure receiving surface area difference between the rod side chamber 5 side and the piston side chamber 6 side of the piston 3 is generated. When the actuator Af is caused to perform the contraction operation, on the other hand, communication between the rod side chamber 5 and the piston side chamber 6 is cut off such that the piston side chamber 6 communicates with the tank 7 via the second passage 10. As a result, a thrust obtained by multiplying the pressure of the working oil in the rod side chamber 5 by the pressure receiving surface area on the rod side chamber 5 side of the piston 3 is generated. Thus, during both expansion and contraction, the thrust generated by the actuator Af takes a value obtained by multiplying the pressure of the working oil in the rod side chamber 5 by half the sectional area of the piston 3. Therefore, the thrust of the actuator Af can be controlled by controlling the pressure of the rod side chamber 5 during both the expansion operation and the contraction operation.

In the actuator Af at this time, the pressure receiving surface area on the rod side chamber 5 side of the piston 3 is set at half the pressure receiving surface area on the piston side chamber 6 side. Therefore, when identical thrust is generated on both the expansion and contraction sides, the pressure in the rod side chamber 5 is identical on both the expansion side and the contraction side, making control simple. Further, the amount of working oil supplied to and discharged from the rod side chamber 5 relative to the displacement amount is also identical, and therefore an identical response is obtained on both the expansion and contraction sides.

It should be noted that the thrust of the actuator Af on the expansion and contraction sides can be controlled using the pressure in the rod side chamber 5 even when the pressure receiving surface area on the rod side chamber 5 side of the piston 3 is not set at half the pressure receiving surface area on the piston side chamber 6 side.

A free end (a left end in FIG. 2) of the rod 4 and the lid 13 that closes one end of the cylinder 2 are provided with attachment portions, not shown in the figures. The actuator Af can be interposed between the vehicle body B and the truck Tf of the railcar by these attachment portions.

The rod side chamber 5 and the piston side chamber 6 are connected by the first passage 8. The first opening/closing valve 9 is provided midway in the first passage 8. The first passage 8 connects the rod side chamber 5 and the piston side chamber 6 on the exterior of the cylinder 2, but instead, a passage connecting the rod side chamber 5 and the piston side chamber 6 may be provided in the piston 3.

The first opening/closing valve 9 is a solenoid opening/closing valve including a valve 9*a* having a communication position 9*b* and a cutoff position 9*c*, a spring 9*d* that biases the valve 9*a* to be switched to the cutoff position 9*c*, and a solenoid 9*e* which, when energized, switches the valve 9*a* to the communication position 9*b* against the spring 9*d*. When switched to the communication position 9*b*, the first opening/closing valve 9 opens the first passage 8 such that the rod side chamber 5 communicates with the piston side chamber 6. When switched to the cutoff position 9*c*, the first opening/closing valve 9 cuts off communication between the rod side chamber 5 and the piston side chamber 6.

The piston side chamber 6 and the tank 7 are connected by the second passage 10. The second opening/closing valve 11 is provided midway in the second passage 10. The second opening/closing valve 11 is a solenoid opening/closing valve including a valve 11*a* having a communication position 11*b* and a cutoff position 11*c*, a spring 11*d* that biases the valve 11*a* to be switched to the cutoff position 11*c*, and a solenoid 11*e* which, when energized, switches the valve 11*a* to the communication position 11*b* against the spring 11*d*. When switched to the communication position 11*b*, the second opening/closing valve 11 opens the second passage 10 such that the piston side chamber 6 communicates with the tank 7. When switched to the cutoff position 11*c*, the second opening/closing valve 11 cuts off communication between the piston side chamber 6 and the tank 7.

The pump 12 is driven by a motor 15. The pump 12 discharges the working oil in only one direction. A discharge port of the pump 12 communicates with the rod side chamber 5 via a supply passage 16, while a suction port of the pump 12 communicates with the tank 7. When driven by the motor 15, the pump 12 suctions the working oil from the tank 7 and supplies the working oil to the rod side chamber 5.

Since the pump 12 discharges the working oil in only one direction, an operation to switch a rotation direction thereof is not required. Therefore, a problem in which a discharge amount varies when the rotation direction is switched does not arise. Hence, an inexpensive gear pump or the like can be applied to the pump 12. Further, the rotation direction of the pump 12 is always the same direction, and therefore the motor 15 serving as a drive source for driving the pump 12 does not require a high response in relation to a rotation switch. Hence, an inexpensive motor may likewise be applied to the motor 15. A check valve 17 that prevents backflow of the working oil from the rod side chamber 5 to the pump 12 is provided in the supply passage 16.

In the railcar damping device 1, the working oil is supplied from the pump 12 to the rod side chamber 5 at a predetermined discharge flow rate. When the actuator Af of the railcar damping device 1 is caused to perform the expansion operation, the pressure in the rod side chamber 5 is regulated by opening the first opening/closing valve 9 and opening and closing the second opening/closing valve 11. When the actuator Af of the railcar damping device 1 is caused to perform the contraction operation, on the other hand, the pressure in the rod side chamber 5 is regulated by opening the second opening/closing valve 11 and opening and closing the first opening/closing valve 9. In so doing, thrust corresponding to the thrust command valve Ff described above can be obtained.

During the expansion operation, the rod side chamber 5 and the piston side chamber 6 are set in a communicative condition such that the pressure in the piston side chamber 6 is identical to the pressure in the rod side chamber 5. Hence, in the railcar damping device 1, the thrust of the actuator Af can be controlled by controlling the pressure in the rod side chamber 5 during both the expansion operation and the contraction operation.

The first opening/closing valve 9 and the second opening/closing valve 11 may be variable relief valves having an adjustable valve opening pressure so as to be capable of opening and closing. In this case, the thrust of the actuator Af can be adjusted during the expansion and contraction operations by adjusting the respective valve opening pressures of the first opening/closing valve 9 and the second opening/closing valve 11 rather than performing opening/closing operations thereon.

Further, thrust corresponding to the thrust command value Ff can be obtained by adjusting the discharge flow rate of the pump 12 similarly. In this case, the thrust output by the actuator Af can be measured by providing a pressure sensor for detecting the pressure of the rod side chamber 5, providing a torque sensor for detecting a torque acting on a rotary shaft of the motor 15 or the pump 12, providing a load cell sensor for detecting a load acting on the rod 4, or providing a distortion sensor for detecting a distortion of the rod 4.

As described above, the thrust of the actuator Af can be adjusted, and to make thrust adjustment easier, the railcar damping device 1 is provided with an exhaust passage 21 that connects the rod side chamber 5 to the tank 7 and a variable relief valve 22 that is provided midway in the exhaust passage 21 and has a modifiable valve opening pressure.

The variable relief valve 22 is a proportional solenoid relief valve including a valve body 22*a* provided in the exhaust passage 21, a spring 22*b* that biases the valve body 22*a* so as to cut off the exhaust passage 21, and a proportional solenoid 22*c* which, when energized, generates thrust against the spring 22*b*. The valve opening pressure of the variable relief valve 22 can be adjusted by adjusting a current amount flowing to the proportional solenoid 22*c*.

In the variable relief valve 22, the pressure of the working oil in the rod side chamber 5 upstream of the exhaust passage 21 acts on the valve body 22*a* as a pilot pressure. When the pressure of the working oil acting on the valve body 22*a* of the variable relief valve 22 exceeds a relief pressure (the valve opening pressure), a resultant force of thrust generated by the pressure of the working oil in the rod side chamber 5 and the thrust generated by the proportional solenoid 22*c* overcomes a biasing force of the spring 22*b* that biases the valve body 22*a* in a direction for cutting off the exhaust passage 21, thereby causing the valve body 22*a* to retreat, and as a result, the exhaust passage 21 is opened.

In the variable relief valve 22, when the current amount supplied to the proportional solenoid 22*c* is increased, the thrust generated by the proportional solenoid 22*c* increases. Hence, when the current amount supplied to the proportional solenoid 22*c* is set at a maximum, the valve opening pressure reaches a minimum, and conversely, when no current is supplied to the proportional solenoid 22*c* at all, the valve opening pressure reaches a maximum.

Hence, by providing the exhaust passage 21 and the variable relief valve 22, the pressure in the rod side chamber 5 is identical to the valve opening pressure of the variable relief valve 22 during the expansion and contraction operations of the actuator Af. Therefore, by adjusting the valve opening pressure of the variable relief valve 22, the pressure in the rod side chamber 5 can be adjusted easily.

By adjusting the valve opening pressure of the variable relief valve 22 in this manner, the thrust of the actuator Af is controlled. There is therefore no need to provide a sensor in order to adjust the thrust of the actuator Af, no need to open and close the first opening/closing valve 9 and the second opening/closing valve 11 at high speed, no need to provide a variable relief valve having a function for opening and closing the first opening/closing valve 9 and the second opening/closing valve 11, and no need to control the motor 15 at high speed in order to adjust the discharge amount of the pump 12. As a result, the railcar damping device 1 can be constructed inexpensively, and a robust system in terms of both hardware and software can be constructed.

When a proportional solenoid relief valve in which the valve opening pressure can be varied proportionally in accordance with the applied current amount is used as the variable relief valve 22, the valve opening pressure can be controlled easily. However, the variable relief valve 22 is not limited to a proportional solenoid relief valve, and any relief valve having an adjustable valve opening pressure may be used.

When an excessive input is input into the actuator Af in an expansion/contraction direction such that the pressure in the rod side chamber 5 exceeds the valve opening pressure of the variable relief valve 22, regardless of the open/closed condition of the first opening/closing valve 9 and the second opening/closing valve 11, the variable relief valve 22 opens the exhaust passage 21 such that the rod side chamber 5 communicates with the tank 7. As a result, the pressure in the rod side chamber 5 escapes into the tank 7, and therefore the entire system of the railcar damping device 1 can be protected. Hence, by providing the exhaust passage 21 and the variable relief valve 22, the system can be protected.

The railcar damping device 1 includes a damper circuit D. The damper circuit D causes the actuator Af to function as a damper when the first opening/closing valve 9 and the second opening/closing valve 11 are both closed. The damper circuit D includes a rectifying passage 18 that is formed in the piston 3 to allow the working oil to flow only from the piston side chamber 6 toward the rod side chamber 5, and a suction passage 19 that allows the working oil to flow only from the tank 7 toward the piston side chamber 6. Further, the railcar damping device 1 includes the exhaust passage 21 and the variable relief valve 22, and therefore, when the actuator Af functions as a damper, the variable relief valve 22 functions as a damping valve.

More specifically, the rectifying passage 18 connects the piston side chamber 6 to the rod side chamber 5, and a check valve 18*a* is provided midway therein. The check valve 18*a* turns the rectifying passage 18 into a one-way passage that allows the working oil to flow only from the piston side chamber 6 toward the rod side chamber 5. The suction passage 19, meanwhile, connects the tank 7 to the piston side chamber 6, and a check valve 19*a* is provided midway therein. The check valve 19*a* turns the suction passage 19 into a one-way passage that allows the working oil to flow only from the tank 7 toward the piston side chamber 6.

It should be noted that by interposing a check valve that allows the working oil to flow only from the piston side chamber 6 toward the rod side chamber 5 in the cutoff position 9*c* of the first opening/closing valve 9, the first passage 8 may also be used as the rectifying passage 18. Further, by interposing a check valve that allows the working oil to flow only from the tank 7 toward the piston side chamber 6 in the cutoff position 11*c* of the second opening/closing valve 11, the second passage 10 may also be used as the suction passage 19.

By providing the damper circuit D configured as described above, when the first opening/closing valve 9 and the second opening/closing valve 11 of the railcar damping device 1 are switched to their respective cutoff positions 9*c*, 11*c*, the rod side chamber 5, the piston side chamber 6, and the tank 7 are connected in a row by the rectifying passage 18, the suction passage 19, and the exhaust passage 21. Since the rectifying passage 18, the suction passage 19, and the exhaust passage 21 allow the working oil to flow in only one direction, when the actuator Af is caused to expand and contract by an external force, working oil discharged from the cylinder 2 is returned to the tank 7 through the exhaust passage 21, while a working oil deficiency in the cylinder 2 is alleviated by supplying working oil into the cylinder 2 from the tank 7 through the suction passage 19.

At this time, the variable relief valve 22 serves as resistance to the flow of working oil, thereby functioning as a pressure control valve that regulates the pressure in the cylinder 2 to the valve opening pressure. Accordingly, the actuator Af functions as a passive uniflow damper.

During a failure in which the respective components of the railcar damping device 1 cannot be energized, the valves 9*a*, 11*a* of the first opening/closing valve 9 and the second opening/closing valve 11 are pressed by the springs 9*d*, 11*d* so as to be switched to their respective cutoff positions 9*c*, 11*c*. At this time, the variable relief valve 22 functions as a pressure control valve having a valve opening pressure that is fixed in a maximum condition. During a failure, therefore, the actuator Af automatically functions as a passive damper.

Instead of providing the variable relief valve 22 and the exhaust passage 21, the damper circuit D may be constituted separately by a passage that connects the rod side chamber 5 and the tank 7 and a damping valve provided midway in the passage.

To cause the actuators Af, Ar to generate a desired thrust in an expansion direction, the controller C rotates the motor 15 to supply the working oil from the pump 12 into the cylinder 2, switches the respective first opening/closing valves 9 to the communication position 9*b*, and switches the second opening/closing valves 11 to the cutoff position 11*c*. As a result, the rod side chamber 5 and the piston side chamber 6 enter the communicative condition such that the working oil is supplied thereto from the pump 12 and the piston 3 is pressed in the expansion direction (leftward in FIG. 2). The actuators Af, Ar thus generate thrust in the expansion direction. At this time, the actuators Af, Ar generate expansion direction thrust of a magnitude obtained by multiplying the pressure in the rod side chamber 5 and the piston side chamber 6 by the pressure receiving surface area difference between the piston side chamber 6 side and the rod side chamber 5 side of the piston 3.

When the pressure in the rod side chamber 5 and the piston side chamber 6 exceeds the valve opening pressure of the variable relief valve 22, the variable relief valve 22 opens such that a part of the working oil supplied from the pump 12 escapes into the tank 7 through the exhaust passage 21. Thus, the pressure in the rod side chamber 5 and the piston side chamber 6 is controlled by the valve opening pressure of the variable relief valve 22, which is determined in accordance with the current amount applied to the variable relief valve 22.

To cause the actuators Af, Ar to generate a desired thrust in a contraction direction, on the other hand, the controller C rotates the motor 15 to supply the working oil from the pump 12 into the rod side chamber 5, switches the first opening/closing valves 9 to the cutoff position 9*c*, and switches the second opening/closing valves 11 to the communication position 11*b*. Accordingly, the piston side chamber 6 and the tank 7 enter the communicative condition such that the working oil is supplied to the rod side chamber 5 from the pump 12, and as a result, the piston 3 is pressed in the contraction direction (rightward in FIG. 2). The actuators Af, Ar thus generate thrust in the contraction direction. At this time, the actuators Af, Ar generate contraction direction thrust of a magnitude obtained by multiplying the pressure in the rod side chamber 5 by the pressure receiving surface area on the rod side chamber 5 side of the piston 3.

At this time, similarly to the operation for generating expansion direction thrust, the pressure in the rod side chamber 5 is controlled by the valve opening pressure of the variable relief valve 22, which is determined in accordance with the current amount applied to the variable relief valve 22.

Further, by switching the open/closed condition of the first opening/closing valve 9 and the second opening/closing valve 11 regardless of a driving condition of the motor 15, the actuators Af, Ar can be caused to function as dampers as well as actuators. Hence, troublesome and rapid valve switching operations are not required, and therefore a highly responsive and reliable system can be provided.

Since single rod type actuators are used as the actuators Af, Ar, a stroke length is easier to secure than with double rod type actuators. Therefore, an overall length of the actuators Af, Ar is shortened, and as a result, the actuators Af, Ar can be installed in the railcar more easily.

As regards the working oil supply from the pump 12 and a working oil flow during the expansion and contraction operations, the working oil passes through the rod side chamber 5 and the piston side chamber 6 of the actuators Af, Ar in that order, and is ultimately recirculated to the tank 7. Therefore, even when gas is intermixed into the rod side chamber 5 or the piston side chamber 6, the gas is automatically discharged into the tank 7 by the expansion and contraction operations of the actuators Af, Ar. As a result, a reduction in responsiveness during thrust generation due to intermixing of gas into the working oil can be prevented.

Hence, when the railcar damping device 1 is manufactured, troublesome operations such as assembling the railcar damping device 1 in oil or in a vacuum environment are not required. Further, an advanced degassing operation need not be performed on the working oil. As a result, a productivity of the railcar damping device 1 is improved, and manufacturing costs can be reduced.

Furthermore, even when gas is intermixed into the rod side chamber 5 and the piston side chamber 6, the gas is automatically discharged into the tank 7 by the expansion and contraction operations of the actuators Af, Ar. Therefore, frequent maintenance operations for the purpose of performance recovery are not required. As a result, labor and cost expended on maintenance can be reduced.

Next, referring mainly to FIGS. 3 and 4, the configuration of the controller C will be described.

As shown in FIG. 1, the controller C includes a front side acceleration sensor 40 that detects the lateral direction acceleration $\alpha f$ of the vehicle body front portion Bf serving as a front side of the vehicle body in the horizontal lateral direction relative to the vehicle advancement direction, and a rear side acceleration sensor 41 that detects the lateral direction acceleration $\alpha r$ of the vehicle body rear portion Br serving as a rear side of the vehicle body in the horizontal lateral direction relative to the vehicle advancement direction. Further, as shown in FIGS. 2 and 3, the controller C includes band pass filters 42, 43 that remove steady-state acceleration during travel on a curve, a drift component, and noise from the lateral direction accelerations $\alpha f$, $\alpha r$, and a control unit 44 that calculates command values from the lateral direction accelerations $\alpha f$, $\alpha r$ filtered by the band pass filters 42, 43 and outputs the calculated command values to the motor 15, the solenoid 9*e* of the first opening/closing valve 9, the solenoid 11*e* of the second opening/closing valve 11, and the proportional solenoid 22*c* of the variable relief valve 22. Thus, the controller C controls the thrust of the respective actuators Af, Ar.

It should be noted that by having the band pass filters 42, 43 remove the steady-state acceleration during travel on a curve included in the lateral direction acceleration $\alpha f$ and the lateral direction acceleration $\alpha r$, the controller C can suppress only vibration that causes passenger comfort to deteriorate.

Figure 3:
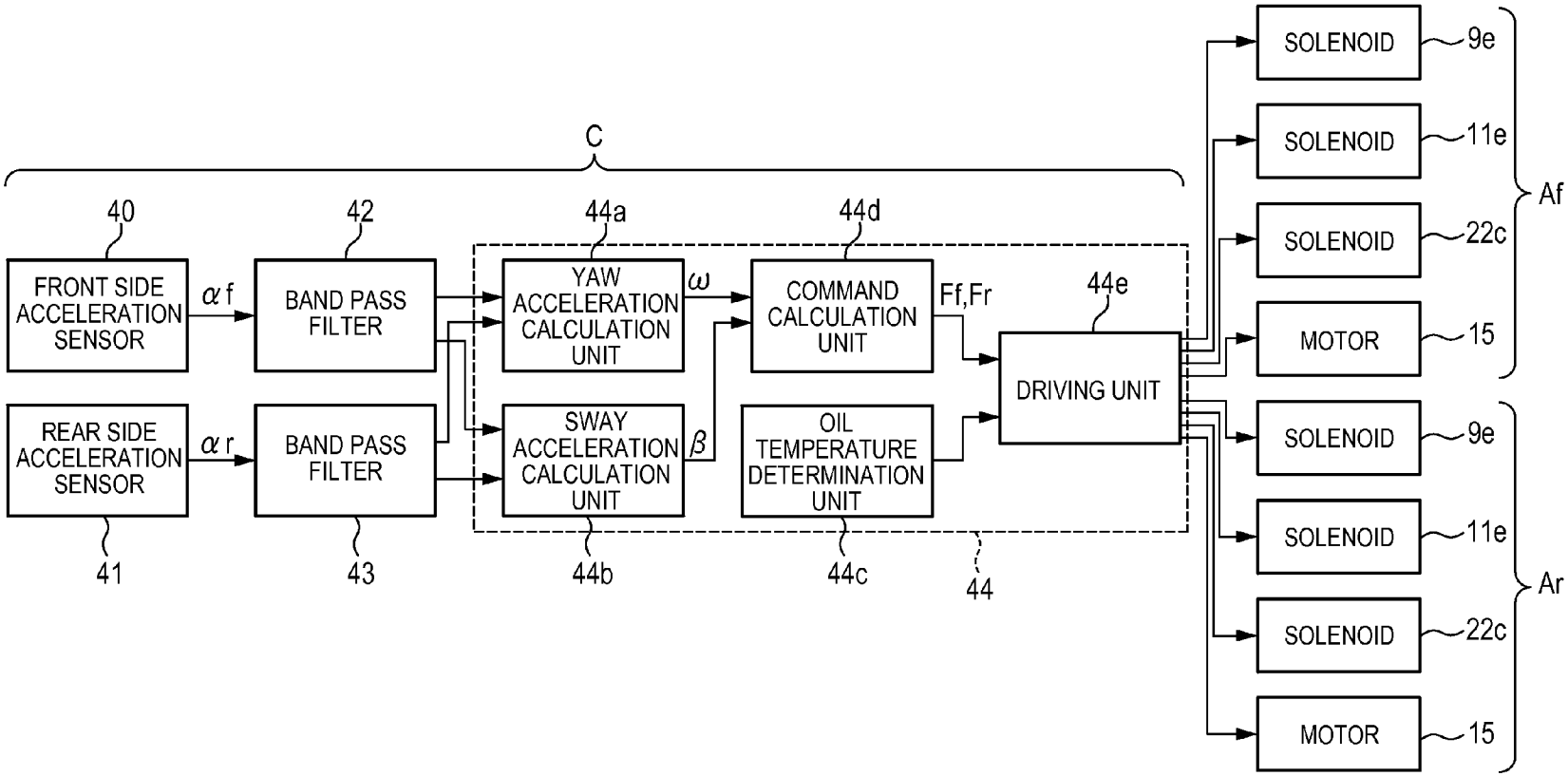
FIG. 3 is a control block diagram of a controller provided in the railcar damping device according to this embodiment of this invention.

As shown in FIG. 3, the control unit 44 includes a yaw acceleration calculation unit 44*a* that calculates the yaw acceleration co about the vehicle body center G directly above the front and rear trucks Tf, Tr on the basis of the lateral direction acceleration $\alpha f$ and the lateral direction acceleration $\alpha r$, a sway acceleration calculation unit 44*b* that calculates the sway acceleration $\beta$ of the vehicle body center G of the vehicle body B on the basis of the lateral direction acceleration $\alpha f$ and the lateral direction acceleration $\alpha r$, an oil temperature determination unit 44*c* serving as a temperature determination unit that determines whether or not a temperature (an oil temperature) of the working oil in the actuators Af, Ar is lower than a preset predetermined temperature, a command calculation unit 44*d* that calculates the thrust command values Ff, Fr indicating the thrust to be generated individually by the front and rear actuators Af, Ar on the basis of the yaw acceleration $\omega$ and the sway acceleration $\beta$, and a driving unit 44*e* that drives the motor 15, the solenoid 9*e* of the first opening/closing valve 9, the solenoid 11*e* of the second opening/closing valve 11, and the proportional solenoid 22*c* of the variable relief valve 22 on the basis of the thrust command values Ff, Fr.

When the oil temperature determination unit 44*c* determines that the oil temperature of the working oil in the actuator Af is equal to or higher than the predetermined temperature, the driving unit 44*e* drives the motor 15 to rotate the pump 12 at a predetermined normal rotation speed. When the oil temperature determination unit 44*c* determines that the oil temperature of the working oil in the actuator Af is lower than the predetermined temperature, on the other hand, the driving unit 44*e* drives the motor 15 to reduce the rotation speed of the pump 12 to a lower rotation speed than the normal rotation speed.

In this embodiment, the driving unit 44*e* drives the front and rear actuators Af, Ar, and therefore the oil temperature of the rear side actuator Ar is determined similarly. The driving unit 44*e* then rotates the pump 12 that supplies working oil to the rear side actuator Ar at the normal rotation speed or the lower rotation speed.

The normal rotation speed is determined to satisfy both a pressure required for the actuators Af, Ar to generate a required maximum thrust and a response speed required to generate thrust for the driving unit 44*e* to drive the first opening/closing valve 9, the second opening/closing valve 11, and the variable relief valve 22.

As hardware, the controller C includes, for example, an A/D converter for converting signals output by the front side acceleration sensor 40 and the rear side acceleration sensor 41 into digital signals and importing the digital signals, the aforesaid band pass filters 42, 43, a storage device such as a ROM (Read Only Memory) storing a program used for the processing required to control the railcar damping device 1, a calculation device such as a CPU (Central Processing Unit) that executes the processing on the basis of the program, and a storage device such as a RAM (Random Access Memory) that provides the CPU with a storage area. The respective units provided in the control unit 44 of the controller C may be realized by having the CPU execute the program for performing the processing described above. Alternatively, instead of providing the band pass filters 42, 43 as hardware, the band pass filters 42, 43 may be realized on software by having the CPU execute the program.

The lateral direction accelerations $\alpha f$, $\alpha r$ are set using an axis that passes through the center of the vehicle body B in the advancement direction (a left-right direction in FIG. 1) as a reference so as to be positive acceleration when oriented in a direction traveling toward the right side (upward in FIG. 1) and negative acceleration when oriented in a direction traveling toward the right side (downward in FIG. 1). The yaw acceleration calculation unit 44*a* calculates the yaw acceleration $\omega$ about the vehicle body center G directly above the front side truck Tf and the rear truck Tr, respectively, by halving a difference between the front side lateral direction acceleration $\alpha f$ and the rear side lateral direction acceleration $\alpha r$. The sway acceleration calculation unit 44*b* calculates the sway acceleration $\beta$ of the vehicle body center G by halving a sum of the lateral direction acceleration $\alpha f$ and the lateral direction acceleration $\alpha r$.

To calculate the yaw acceleration $\omega$, the front side acceleration sensor 40 is preferably disposed in the vicinity of the front side actuator Af on a line extending in a front-rear direction or a diagonal direction including the vehicle body center G of the vehicle body B. Similarly, the rear side acceleration sensor 41 is preferably disposed in the vicinity of the rear side actuator Ar on a line extending in a front-rear direction or a diagonal direction including the vehicle body center G of the vehicle body B.

The yaw acceleration $\omega$ can also be calculated from respective distances between the vehicle body center G and the acceleration sensors 40, 41, positional relationships therebetween, and the lateral direction accelerations $\alpha f$, $\alpha r$. Therefore, installation positions of the acceleration sensors 40, 41 may be set as desired. In this case, instead of determining the yaw acceleration $\omega$ by halving the difference between the lateral direction acceleration $\alpha f$ and the lateral direction acceleration $\alpha r$, the yaw acceleration $\omega$ is calculated from the difference between the lateral direction acceleration $\alpha f$ and the lateral direction acceleration $\alpha r$, the respective distances between the vehicle body center G and the acceleration sensors 40, 41, and the positional relationships therebetween.

More specifically, when a front-rear direction distance between the front side acceleration sensor 40 and the vehicle body center G is set as Lf and a front-rear direction distance between the rear side acceleration sensor 41 and the vehicle body center G is set as Lr, the yaw acceleration $\omega$ is calculated from $\omega=(\alpha f-\alpha r)/(Lf+Lr)$. It should be noted that the yaw acceleration $\omega$ may be detected using a yaw acceleration sensor instead of being calculated from the accelerations detected by the front side acceleration sensor 40 and the rear side acceleration sensor 41.

The oil temperature determination unit 44*c* determines whether or not the oil temperature of the working oil supplied to the actuators Af, Ar is lower than the predetermined temperature, and outputs a determination result to the driving unit 44*e*. The oil temperature determination unit 44*c* determines whether or not the oil temperature is lower than the predetermined temperature on the basis of date information, for example. More specifically, when a date obtained from the date information belongs to a winter period, the oil temperature determination unit 44*c* determines that the oil temperature is lower than the predetermined temperature. During the winter period, the oil temperature falls, and therefore the oil temperature can be determined from the date information as described above.

The winter period may specify a period defined only by the month of the date, for example November to February. Alternatively, the period may be specified using the day, for example November 16 to February 20. The date information can be obtained from a real time clock included in the CPU of the control unit 44, or from an external device provided on the outside of the controller C. In this case, the date information may be obtained from a vehicle monitor that monitors various information relating to the railcar, for example. When the date information is obtained from an external device, the date information can be obtained from the external device through either wireless or wired communication.

The predetermined temperature is set on the basis of a temperature characteristic of the working oil used in the railcar damping device 1. Here, when the oil temperature of the working oil decreases such that a viscosity of the working oil increases and the pump 12 is driven to rotate at the normal rotation speed, basic pressure loss in the hydraulic circuit of the railcar damping device 1 increases by an amount corresponding to the increase in viscosity. As a result, the pressure of the working oil in the cylinder 2 increases. Hence, when the oil temperature of the working oil decreases, a lower limit of the pressure in the cylinder 2 increases, and as a result, a lower limit of the thrust generated by the actuators Af, Ar also increases.

The predetermined temperature may be set as desired, but is preferably set at a limit temperature of the working oil at which the actuators Af, Ar can no longer output the required lower limit thrust when the pump 12 is rotated at the predetermined normal rotation speed. Accordingly, the winter period is preferably set at a period in which there is a possibility of the oil temperature falling to or below the limit temperature. Needless to mention, the predetermined temperature may be set differently according to the temperature and viscosity characteristics of the working oil used in the actuators Af, Ar.

The oil temperature determination unit 44*c* can also determine whether or not the oil temperature is lower than the predetermined temperature on the basis of air temperature information relating to a travel region of the railcar. In this case, the oil temperature of the working oil in the actuators Af, Ar can be determined to be lower than the predetermined temperature when the travel region of the railcar is a cold region. More specifically, the air temperature information may be information that allows the oil temperature determination unit 44*c* to determine whether or not there is a possibility of the oil temperature falling below the predetermined temperature. The air temperature information may be determined from an average air temperature or a minimum air temperature of the travel region, for example. The air temperature information may also be set differently within a single region according to the date. In other words, the determination as to whether or not the oil temperature is lower than the predetermined temperature may be made using a map or a table on which the air temperature information is associated with the date information.

The oil temperature determination unit 44*c* can also determine whether or not the oil temperature is lower than the predetermined temperature on the basis of a travel position of the railcar. More specifically, the oil temperature determination unit 44*c* monitors the travel position from a vehicle monitor, a GPS (Global Positioning System), or another device capable of monitoring the travel position, and refers to the air temperature information of the region including the travel position. The oil temperature determination unit 44*c* then determines whether or not the oil temperature is lower than the predetermined temperature on the basis of this air temperature information. By performing the determination in this manner, the oil temperature can be determined in accordance with the travel position in a case where the railcar travels on a line that passes from a warm region into a cold region. The date information may also be taken into consideration such that the air temperature information of the region to which the travel position belongs differs according to the date. Likewise in this case, the determination as to whether or not the oil temperature is lower than the predetermined temperature may be made using a map or a table on which the air temperature information is associated with the date information by referring to the map or the table in the region to which the travel position belongs.

As described above, the oil temperature determination unit 44*c* can determine whether or not the oil temperature is lower than the predetermined temperature on the basis of any of the date information, the air temperature information, and the travel position, or a desired combination thereof.

The oil temperature determination unit 44*c* can also determine whether or not the oil temperature is lower than the predetermined temperature on the basis of time information. For example, the oil temperature determination unit 44*c* may make different determinations depending on the date obtained from the date information and a time obtained from the time information. Thus, even on the same date obtained from the date information, the oil temperature can be determined to be not lower than the predetermined temperature in the afternoon and lower than the predetermined temperature in the early morning or at night. As a result, the oil temperature can be determined in a more sophisticated manner. Further, by associating the air temperature information with the time information, the oil temperature can be determined in a more sophisticated manner likewise in a case where the oil temperature is determined on the basis of the air temperature information and the travel position.

The oil temperature determination unit 44*c* can also determine whether or not the oil temperature is lower than the predetermined temperature on the basis of an operation duration following startup of the railcar damping device 1. When the railcar damping device 1 has been started up recently, the oil temperature of the working oil supplied to the actuators Af, Ar is low. Until the oil temperature rises, therefore, the oil temperature may be determined to be lower than the predetermined temperature. Hence, when the operation duration is short, the oil temperature may be determined to be lower than the predetermined temperature. The operation duration is set at a duration required for the oil temperature of the working oil supplied to the actuators Af, Ar to increase sufficiently such that the viscosity of the working oil decreases sufficiently. It should be noted that the oil temperature determination based on the operation duration may be combined with the above oil temperature determinations based on the date information, the air temperature information, the travel position, and the time information.

The oil temperature of the working oil supplied to the actuators Af, Ar may also be detected directly by an oil temperature sensor and compared to the predetermined temperature by the oil temperature determination unit 44*c* to determine whether or not the detected oil temperature is lower than the predetermined temperature. In this case, oil temperature sensors may be disposed in the cylinder 2, the tank 7, or respective passages of the actuators Af, Ar in order to detect the oil temperature. As described above, however, the oil temperature can be estimated using the date information, time information, and air temperature information without the need for oil temperature sensors, and in so doing, the cost of the railcar damping device 1 can be reduced.

Figure 4:
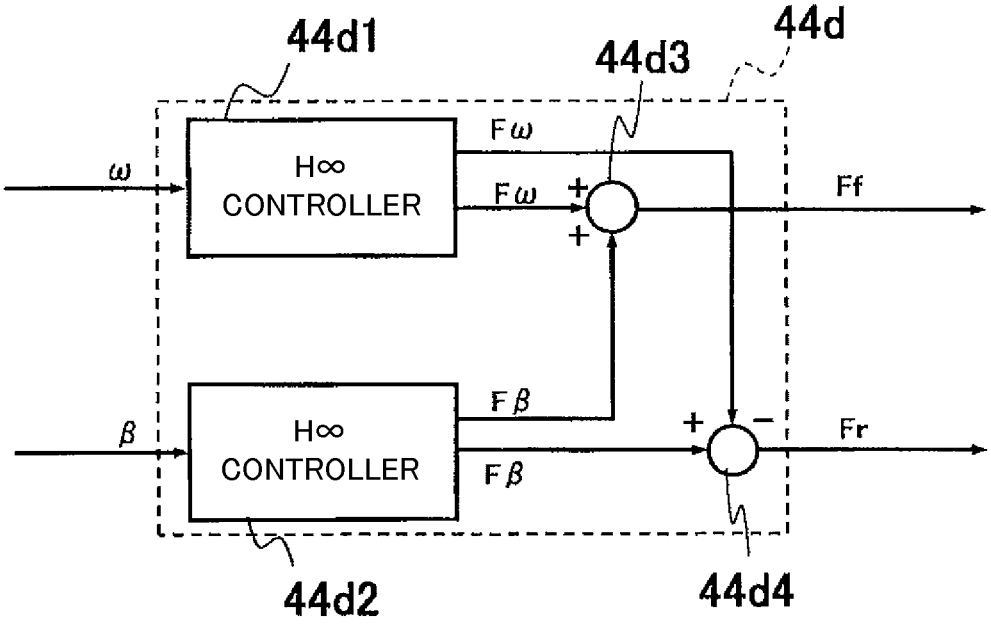
FIG. 4 is a control block diagram of a command calculation unit of the controller provided in the railcar damping device according to this embodiment of this invention.

As shown in FIG. 4, the command calculation unit 44*d* is configured to include H∞ controllers 44*d*1, 44*d*2. The command calculation unit 44*d* includes the H∞ controller 44*d*1 that calculates a thrust Fω (a yaw command value) for suppressing yaw vibration of the vehicle body B from the yaw acceleration ω calculated by the yaw acceleration calculation unit 44*a*, the H∞ controller 44*d*2 that calculates a thrust Fβ (a sway command value) for suppressing sway vibration of the vehicle body B from the sway acceleration β calculated by the sway acceleration calculation unit 44*b*, an adder 44*d*3 that calculates the thrust command value Ff indicating the thrust to be output by the front side actuator Af by adding together the thrust Fω and the thrust Fβ, and a subtractor 44*d*4 that calculates the thrust command value Fr indicating the thrust to be output by the rear side actuator Ar by subtracting the thrust Fω from the thrust Fβ.

Since H∞ control is executed by the command calculation unit 44*d*, a superior damping effect can be obtained irrespective of a frequency of the vibration input into the vehicle body B, and as a result, a high degree of robustness can be obtained. However, this does not preclude the use of control other than H∞ control. Therefore, for example, the front and rear actuators Af, Ar may also be controlled using skyhook control in which a lateral direction acceleration is obtained from the lateral direction accelerations αf, αr and a thrust command value is determined by multiplying the lateral direction acceleration by a skyhook damping coefficient. Further, instead of the controlling the thrust values of the front and rear actuators Af, Ar in conjunction from the yaw acceleration ω and the sway acceleration β, the front side actuator Af and the rear side actuator Ar may be controlled independently of each other.

As shown in FIG. 3, the driving unit 44*e* outputs control commands to cause the actuators Af, Ar to generate thrust corresponding to the respective thrust command values Ff, Fr. More specifically, the driving unit 44*e* calculates control commands to be output to the motor 15, the solenoid 9*e* of the first opening/closing valve 9, the solenoid 11*e* of the second opening/closing valve 11, and the proportional solenoid 22*c* of the variable relief valve 22, and outputs the calculated control commands. Further, when calculating the control commands from the thrust command values Ff, Fr, the control commands may be calculated using feedback control by feeding back the thrust output by the actuators Af, Ar at that time.

More specifically, as described above, the driving unit 44*e* calculates the control commands to be output to the solenoid 9*e* of the first opening/closing valve 9, the solenoid 11*e* of the second opening/closing valve 11, and the proportional solenoid 22*c* of the variable relief valve 22 from the thrust command values Ff, Fr, and outputs the calculated control commands. In addition, the driving unit 44*e* controls the rotation speed of the pump 12 in accordance with the determination result obtained by the oil temperature determination unit 44*c*.

When the oil temperature determination unit 44*c* determines that the oil temperature is equal to or higher than the predetermined temperature, the driving unit 44*e* drives the motor 15 to rotate the pump 12 at the normal rotation speed. In this embodiment, the thrust of the actuators Af, Ar can be adjusted by the variable relief valve 22 by driving the pump 12 to rotate at the normal rotation speed when the oil temperature is equal to or higher than the predetermined temperature. Therefore, the rotation speed of the pump 12 does not have to be varied, and as a result, noise generated by variation in the rotation speed of the pump 12 can be prevented and a control response of the actuators Af, Ar can be improved. It should be noted that in addition to pressure adjustment by the variable relief valve 22, the thrust generated by the actuators Af, Ar may also be adjusted by adjusting the rotation speed of the motor 15.

When the oil temperature determination unit 44*c* determines that the oil temperature is lower than the predetermined temperature, on the other hand, the driving unit 44*e* reduces the rotation speed of the pump 12. In other words, the driving unit 44*e* drives the motor 15 to rotate the pump 12 at a low temperature rotation speed, which is set in advance at a lower rotation speed than the normal rotation speed.

The low temperature rotation speed is set at a fixed rotation speed at which the lower limit thrust required of the actuators Af, Ar can be output even when the oil temperature of the working oil is lower than the predetermined temperature. Typical feedback control of a speed loop may be used to control the rotation speed of the motor 15, but another control method may also be used.

With the railcar damping device 1 according to this embodiment, configured as described above, when the oil temperature is determined to be low, the rotation speed of the pump 12 is reduced to the low temperature rotation speed, which is lower than the normal rotation speed. Therefore, even when the actuators Af, Ar are caused to generate comparatively small thrust in a condition where the viscosity of the working oil is high, the thrust does not become excessive.

Further, with the railcar damping device 1 according to this embodiment, in a case where the thrust of the actuators Af, Ar is feedback-controlled, the thrust does not become excessive even when the working oil is low in temperature and high in viscosity. Therefore, the deviation between the thrust command values Ff, Fr and the actual output thrust does not increase. Accordingly, hunting in which the thrust of the actuators Af, Ar becomes oscillatory does not occur. As a result, the vehicle body B of the railcar is not caused to vibrate, and a vibration condition does not deteriorate.

Hence, with the railcar damping device 1 according to this embodiment, stable thrust can be generated even when the oil temperature is low, and as a result, vehicle body vibration can be suppressed effectively.

Further, since hunting does not occur, the first opening/closing valve 9 and the second opening/closing valve 11 are not switched frequently, and therefore problems such as a reduction in the lifespan thereof and a corresponding reduction in economic efficiency also do not occur.

Moreover, when the oil temperature determination unit 44*c* determines whether or not the oil temperature is lower than the predetermined temperature on the basis of one or a combination of the date information, the air temperature information relating to the travel region, the time information, the travel position, and the operation duration following startup, an oil temperature sensor for detecting the oil temperature is not required, and therefore the cost of the railcar damping device 1 can be reduced correspondingly.

Furthermore, by having the oil temperature determination unit 44*c* determine whether or not the oil temperature is lower than the predetermined temperature using a combination of the date information, the air temperature information relating to the travel region, the time information, the travel position, and the operation duration following startup, the oil temperature can be estimated in a sophisticated manner without using an oil temperature sensor.

Although the invention has been described above with reference to certain embodiments, the invention is not limited to the embodiments described above. Modifications and variations of the embodiments described above will occur to those skilled in the art, within the scope of the claims.

The contents of Tokugan 2011-136162, with a filing date of Jun. 20, 2011 in Japan, are hereby incorporated by reference.

The embodiments of this invention in which an exclusive property or privilege is claimed are defined as follows:

1. A railcar damping device that suppresses vibration of a vehicle body by controlling an actuator, wherein the actuator comprises:

a cylinder coupled to one of a truck and a vehicle body of a railcar;

a piston inserted into the cylinder to be free to slide;

a rod inserted into the cylinder and coupled to the piston and the other of the truck and the vehicle body; and a rod side chamber and a piston side chamber defined within the cylinder by the piston, wherein the railcar damping device comprises:

a tank that is configured to store a liquid that is supplied to and discharged from the cylinder;

a first opening/closing valve provided in a first passage connecting the rod side chamber to the piston side chamber to be capable of opening and closing the first passage;

a second opening/closing valve provided in a second passage connecting the piston side chamber to the tank to be capable of opening and closing the second passage;

a pump that is configured to be driven to rotate at a predetermined normal rotation speed in order to supply the liquid from the tank to the rod side chamber; and a temperature determination unit that is configured to determine a temperature of the liquid supplied to the actuator, wherein a rotation speed of the pump is reduced below the normal rotation speed when the temperature determination unit determines that the temperature of the liquid is lower than a predetermined temperature.

2. The railcar damping device as defined in claim 1, wherein the temperature determination unit is configured to determine whether or not the temperature of the liquid is lower than the predetermined temperature on the basis of date information.

3. The railcar damping device as defined in claim 1, wherein the temperature determination unit is configured to determine whether or not the temperature of the liquid is lower than the predetermined temperature on the basis of air temperature information in a travel region of the railcar.

4. The railcar damping device as defined in claim 1, wherein the temperature determination unit is configured to determine whether or not the temperature of the liquid is lower than the predetermined temperature on the basis of a travel position of the railcar.

5. The railcar damping device as defined in claim 1, wherein the temperature determination unit is configured to determine whether or not the temperature of the liquid is lower than the predetermined temperature on the basis of time information.

6. The railcar damping device as defined in claim 1, wherein the temperature determination unit is configured to determine whether or not the temperature of the liquid is lower than the predetermined temperature on the basis of an operation duration.

7. The railcar damping device as defined in claim 1, further comprising:

an exhaust passage connecting the rod side chamber to the tank; and a variable relief valve that is provided midway in the exhaust passage and has a modifiable valve opening pressure.

8. The railcar damping device as defined in claim 7, wherein a thrust of the actuator is controlled by adjusting the valve opening pressure of the variable relief valve.

9. The railcar damping device as defined in claim 1, wherein, during an expansion operation of the actuator, a thrust is controlled by opening the first opening/closing valve and opening and closing the second opening/closing valve, and during a contraction operation of the actuator, the thrust is controlled by opening the second opening/closing valve and opening and closing the first opening/closing valve.

10. The railcar damping device as defined in claim 1, further comprising:

a suction passage that is configured to allow the liquid to flow only from the tank toward the piston side chamber; and a rectifying passage that is configured to allow the liquid to flow only from the piston side chamber toward the rod side chamber.

11. An apparatus for controlling vibrations by controlling an actuator, the actuator including a cylinder coupled to one of a truck of a railcar and a vehicle body of the railcar, a piston inserted into the cylinder so as to be slidable, a rod inserted into the cylinder and coupled to the piston and the other of the truck and the vehicle body, and a rod side chamber and a piston side chamber defined within the cylinder by the piston, the apparatus comprising:

a tank that stores a liquid that is supplied to and discharged from the cylinder of the actuator;

a first opening/closing valve provided in a first passage so as to be capable of opening and closing the first passage, the first passage connecting the rod side chamber to the piston side chamber;

a second opening/closing valve provided in a second passage so as to be capable of opening and closing the second passage, the second passage connecting the piston side chamber to the tank;

a pump configured to be driven to rotate at a rotation speed to supply the liquid from the tank to the rod side chamber;

a temperature determination unit configured to determine a temperature of the liquid of the actuator; and a driving unit for controlling the rotation speed of the pump to be at a predetermined normal rotation speed when the temperature determination unit determines that the temperature of the liquid is equal to or higher than a predetermined temperature, and another rotation speed that is below the predetermined normal rotation speed when the temperature determination unit determines that the temperature of the liquid is lower than the predetermined temperature.

* * * * *